US011389918B2

(12) United States Patent
Himmelsbach

(10) Patent No.: US 11,389,918 B2
(45) Date of Patent: Jul. 19, 2022

(54) GRINDING-SUPPORTING DEVICE

(71) Applicant: Erwin Junker Maschinenfabrik GmbH, Nordrach (DE)

(72) Inventor: Georg Himmelsbach, Haslach (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 789 days.

(21) Appl. No.: 14/615,787

(22) Filed: Feb. 6, 2015

(65) Prior Publication Data

US 2015/0246422 A1 Sep. 3, 2015

Related U.S. Application Data

(62) Division of application No. 13/376,953, filed as application No. PCT/EP2010/057993 on Jun. 8, 2010.

(30) Foreign Application Priority Data

Jun. 8, 2009 (DE) ..... 10 2009 024 209.0

(51) Int. Cl.
*B24B 5/42* (2006.01)
*B24B 41/06* (2012.01)
*B24B 47/02* (2006.01)

(52) U.S. Cl.
CPC ..... *B24B 5/42* (2013.01); *B24B 41/065* (2013.01); *B24B 47/02* (2013.01)

(58) Field of Classification Search
CPC ..... B24B 41/065; B24B 5/421; B24B 5/42; B24B 41/06; B24B 27/0076; B24B 47/02; B23Q 1/76

(Continued)

(56) References Cited

U.S. PATENT DOCUMENTS 2,017,875 A * 10/1935 Theler ..... B24B 5/22 451/209
2,597,167 A * 5/1952 Musyl ..... B24B 5/42 451/210

(Continued)

FOREIGN PATENT DOCUMENTS

DE 101 44 644 4/2003
DE 102009024209 A1 * 12/2010 ..... B24B 5/421

(Continued)

OTHER PUBLICATIONS

Notice of Preliminary Rejection, Application No. 10-2011-7029479 to Korea, Korean Intellectual Property Office, dated Jun. 18, 2016.

*Primary Examiner* — Monica S Carter
*Assistant Examiner* — Marcel T Dion
(74) *Attorney, Agent, or Firm* — Marshall, Gerstein & Borun LLP

(57) ABSTRACT

In an apparatus for multiple-bearing grinding of workpieces, such as crankshafts, wherein a support element seat occurs at a bearing point at the same time as the grinding of the main bearing, a grinding-supporting unit is used that contains a grinding spindle head having at least one grinding disk and support elements in the form of support jaws or support bodies that can be swiveled in. After the support point seat is ground, the support elements are brought into contact there-with and support the workpiece during the further machining. The simultaneous grinding of the support point seat and several bearing points results in a reduction in the machining time in the grinding of the workpiece compared to the prior art.

14 Claims, 8 Drawing Sheets

(58) Field of Classification Search
USPC ..... 451/134, 140, 143, 62, 47, 408
See application file for complete search history.

(56) References Cited

U.S. PATENT DOCUMENTS

| | | | | |
|---|---|---|---|---|
| 2,750,715 | A | 6/1956 | Farnam | |
| 4,269,551 | A * | 5/1981 | Kralowetz | B23C 3/06 29/888.08 |
| 4,823,657 | A * | 4/1989 | Welin-Berger | B23Q 1/76 451/408 |
| 5,237,780 | A * | 8/1993 | Lessway | B23Q 1/76 451/408 |
| 5,355,633 | A * | 10/1994 | Ishikawa | B24B 41/065 451/10 |
| 5,722,878 | A | 3/1998 | Phillips | |
| 6,077,146 | A | 6/2000 | Sato et al. | |
| 6,419,563 | B1 * | 7/2002 | Ido | B24B 5/42 451/49 |
| 6,878,043 | B1 | 4/2005 | Junker | |
| 6,913,522 | B2 | 7/2005 | Junker | |
| 7,597,035 | B2 * | 10/2009 | Rehm | B23Q 1/76 451/408 |
| 8,491,357 | B2 * | 7/2013 | Hessbrueggen | B24B 41/062 451/399 |
| 8,574,031 | B2 * | 11/2013 | Dibner | B24B 27/0076 451/190 |
| 9,077,146 | B2 | 7/2015 | Islam | |
| 2003/0077994 | A1 * | 4/2003 | Lessway | B23Q 1/76 451/408 |
| 2004/0248502 | A1 | 12/2004 | Junker | |
| 2009/0307886 | A1 * | 12/2009 | Chiba | B24B 5/42 29/90.01 |
| 2010/0233939 | A1 * | 9/2010 | Schmitz | B24B 19/12 451/49 |
| 2013/0029567 | A1 * | 1/2013 | Hessbrueggen | B24B 41/02 451/259 |

FOREIGN PATENT DOCUMENTS

| | | | | |
|---|---|---|---|---|
| DE | WO 2010142670 | A1 * | 12/2010 | B24B 5/421 |
| JP | 1999188621 | A | 7/1999 | |
| JP | 2006-346802 | | 12/2006 | |
| KR | 20040030974 | A | 4/2004 | |

* cited by examiner

GRINDING-SUPPORTING DEVICE

REFERENCE TO RELATED APPLICATION

This is a divisional application of Ser. No. 13/376,953, filed Dec. 30, 2011 which is currently pending. The subject matter of the aforementioned prior application is hereby incorporated herein by reference.

BACKGROUND OF THE INVENTION

The invention relates to a method for the multiple-bearing grinding of workpieces, in which a plurality of bearing points are ground simultaneously by means of a grinding wheel set, wherein at least one bearing point is at least partly supported, during the grinding for compensating for deformations of the workpiece caused by grinding forces. The invention also relates to apparatus for the multiple-bearing grinding of workpieces, in which a plurality of bearing points are ground simultaneously by means of a grinding wheel set which can be fed in at least in the radial X1 direction with respect to the workpiece on a common grinding spindle in a multiple-bearing grinding headstock, wherein at least one bearing point is at least partly supported during the grinding on a supporting element seat like a steady rest seat for compensating for deformations of the workpiece caused by grinding forces, and wherein the workpiece can be set in rotation about a rotation axis by means of a work headstock, for the use of the method according to the preamble of claim 8.

Such a method and an associated device is known from DE 101 44 644 B4. According to this document, the supporting element seat is initially ground using a grinding attachment and then the steady rest is set and the bearing seats are then ground on the crankshaft. This method has the disadvantage that no other machining can take place during the grinding of the supporting element. The machining time on the workpiece is therefore considerably increased.

SUMMARY OF THE INVENTION

The object of the invention is therefore to provide a method and apparatus of the type mentioned hereinabove in which the machining time for the workpiece is further reduced compared with the prior art.

This object is achieved in that a grinding wheel for grinding a supporting element seat like a steady rest seat is fed in to at least one bearing point and grinds the supporting element seat at least in an axial section of this bearing point, in that the grinding wheels of the grinding wheel set at least partly grind the side faces and/or the bearing surfaces of the bearing points during the grinding with the grinding wheel for grinding a supporting element seat, in that, after the finish grinding of the supporting element seat, the grinding wheel for grinding a supporting element seat is withdrawn by a small amount of lift or is set in a freely rotating manner, in that one or more force-absorbing elements are then brought to bear against the respectively finish-ground supporting element seat, and in that the bearing points are then finish-ground using the grinding wheel set.

The workplaces to be machined according to the method according to the invention are preferably crankshafts which are mass-produced and in which any reduction in the machine time is economically advantageous. However, the method can also be used with other workpieces if said workpieces can be machined, by grinding and permit the use of supporting elements, such as steady rests, according to the prior art.

As a result of the procedure according to the invention, the bearing points and/or the flat sides of the bearing points of the crankshafts can already be machined during the grinding of the supporting element seat. The bearing points also no longer need to be produced to their final size in width by means of separate processing steps or operations, since this can be integrated into this operation without appreciably increasing the grinding times. As a result, the machining time can also be minimized in preceding operations. This is reflected in the costs of producing the workplace since production can be more cost effective.

Thus at least some of the hitherto necessary preceding machining operations can be dispensed with, or increased tolerances can be used in the preceding machining sequences, which again has an effect in lower machining costs in the preceding machining sequences.

During the grinding of the supporting element seat, grinding can already be carried out at the flat sides of the bearing points by the grinding wheels at the bearing points. As a result, the machine is already fully in use during the grinding of the supporting element seat, and therefore very high cutting capacities and thus reduced machining times can be achieved.

The grinding of the flat sides having the bearing seats also has advantages with regard to the dimensional, geometrical and positional accuracy, since the flat shoulders at the bearing points are ground in the same setup as the bearing points themselves. Considerable advantages with regard to the production quality of the workpieces can be achieved here according to this method.

If the flat shoulders at the bearing points can be ground at least partly to finished size during the grinding of the supporting element seat, the initial grinding of the supporting element seat can account for a considerable proportion of the grinding time. This reduction in the main time during the grinding by grinding the flat sides at the same time as the supporting element seat has an especially advantageous effect during the grinding of mass-produced crankshafts, since the cost pressure is very high here.

In this machining method, grinding is preferably carried out using grinding wheels having a grinding layer of ceramically bonded CBN. However, all other known grinding materials are also conceivable for the grinding tools.

The invention can be applied to grinding machine concepts having one or more grinding headstocks or grinding stations. Preferred fields of application are the grinding of crankshafts or camshafts or generally of workpieces having a plurality of spaced-apart regions which can be ground simultaneously with a grinding wheel set.

In an advantageous embodiment of the method supporting element seats are ground at a plurality of bearing points by means of associated grinding wheels. For this purpose, these grinding wheels are preferably arranged on a common grinding spindle, and one or more supporting elements are advantageously assigned as force-absorbing elements to said grinding wheels. During the grinding of supporting element seats, however, a plurality of grinding-supporting arrangements can also be mounted on the machine, such that the supporting element seats can be ground independently of one another.

The supporting elements are brought into engagement with and disengaged from the associated supporting element seat by pivoting about a pivot axis or by a linear movement. The CNC control of the grinding machine is preferably used as computer control for the activation of the supporting elements, said CNC control controlling the infeed of all the grinding wheels and of the supporting elements and coordinating all the sequences of movement and the grinding operations.

In an advantageous embodiment of the method, the supporting element seat is ground only to a preliminary size of the bearing point close to the final size and the supporting element is set only to this preliminary size. In this case, this preliminary size close to the final size is only slightly larger than the desired size of the finish-ground bearing seat. The bearing seat is then finish-ground.

According to a further, especially advantageous embodiment, the supporting element, according to the advance of the finish grinding using the grinding wheel set, follows the adjustment thereof in the X1 direction by an adjustment in the X2 direction coordinated therewith, that is to say in the opposite direction. As a result, the position of the supporting element follows the decreasing diameter of the ground bearing seat and can therefore always exert an optimum supporting effect. As a result, the precision of the grinding is markedly increased.

To achieve the object already mentioned at the beginning, in the apparatus for carrying out the method of the invention, there is provided, spaced from the multiple-bearing grinding headstock, at least one further grinding headstock as part of a grinding-supporting unit having a grinding wheel for grinding a supporting element seat, the grinding-supporting unit is capable of being fed in to the workpiece and removed therefrom in the radial X2 direction, and the grinding-supporting unit is arranged with at least one movable supporting element in the region of the grinding wheel for grinding a supporting element seat, which supporting element can be brought to bear against the supporting element seat.

In the apparatus of the invention, the grinding-supporting unit, which comprises as essential subassemblies a grinding headstock and movable supporting elements, is arranged on the same machine bed as the multiple-bearing grinding headstock. However, it preferably lies on the opposite side of the workpiece and can be fed in from there to the workpiece or removed from it. It is thereby possible to bring the grinding wheel and/or the supporting elements into engagement with a bearing point, to be ground, of the workpiece, while at the same time the grinding wheels of the multiple-bearing grinding headstock are already in grinding engagement on the opposite side of the workpiece.

With the apparatus according to the invention, a supporting element seat, i.e. a ground bearing way for one or more supporting elements, can be ground, while at the same time the grinding of the bearing points using the grinding wheel set can already be started on the opposite side of the workpiece. As a result, the loss of time in the prior art due to the fact that a steady rest seat has to be ground first before a steady rest can be set and the actual grinding of the bearing points started does not occur.

Coordination of the infeeds of multiple-bearing grinding headstock and grinding-supporting unit in the X1 direction and X2 direction, respectively, that is to say toward the workpiece and away therefrom, permits especially sensitive and flexible matching of the individual method steps. In particular, this measure opens up the possibility of using the grinding-supporting unit like a "following steady rest" in such a way that it follows a diameter, decreasing in the course of the grinding, of the workpiece at the engagement point.

An arrangement of the movable supporting elements on the grinding headstock simplifies the control and the complexity of the design, since both subassemblies can be mounted and fed in together on a common cross slide. In addition, a robust and compact arrangement of the functional subassemblies can thus be achieved.

The supporting elements used are preferably supporting jaws pivotable about a pivot axis or those which can be displaced on a straight path via a drive. The movement for engaging or disengaging the supporting elements is advantageously controlled by the CNC control of the grinding machine.

Each of the supporting elements has, in the intended region in contact with the workpiece, the supporting point, a wear- and friction-reducing coating which preferably consists of polycrystalline diamond (PCD) or of cubic boron nitride (CBN). The supporting element or elements, for favorable absorption of the grinding forces, have at least two supporting points, which can be realized, for example, by two supporting jaws having one supporting point each or by a compact supporting point having two supporting points arranged at a distance from one another.

The invention will subsequently be explained in more detail with reference to exemplary embodiments which are shown in the figures. In the drawing:

DETAILED DESCRIPTION OF THE INVENTION

Figure 1:
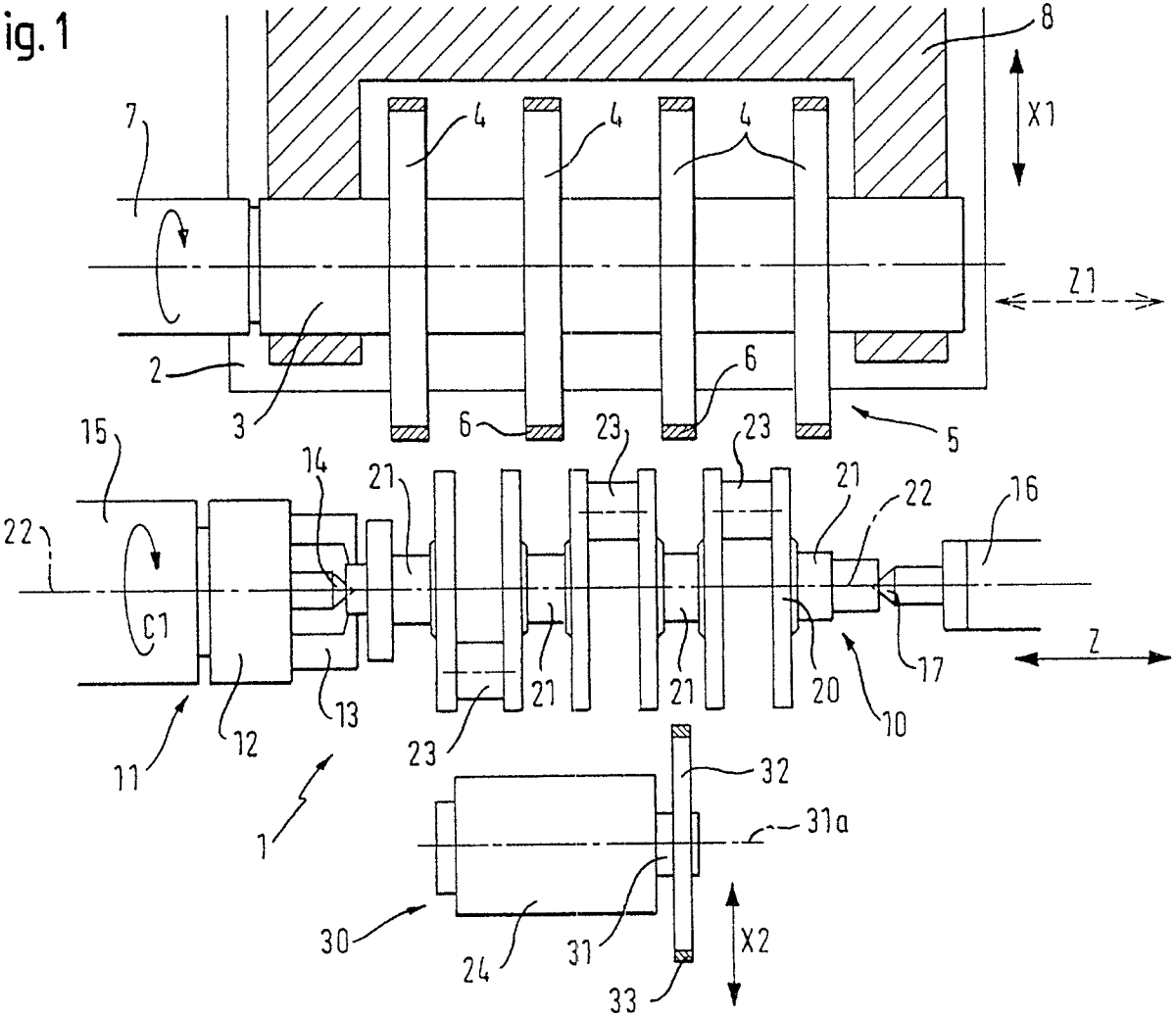
FIG. 1 shows a partial plan view of a grinding machine according to the invention for grinding the bearing points of a crankshaft.

FIG. 1 shows a partial plan view of a grinding machine 1 according to the invention. Located in the rear region on an infeed slide 2 is a rotationally driven grinding spindle 3 which accommodates a plurality of grinding wheels 4 for grinding centrally clamped bearing points 21 of the workpiece 10. The grinding wheels 4 form the grinding wheel set 5 and have a grinding layer 6 on their circumference. They are set in rotation via the grinding spindle 3 and the rotary drive 7 thereof, which is indicated by the curved arrow. Here, the multiple-bearing grinding headstock 8 is fitted with four grinding wheels 4 for the simultaneous grinding of the four main bearings 21 of a crankshaft 20 and can be fed in and removed in the direction of the double arrow X1, i.e. at right angles to the center axis of the workpiece 10.

Here, the workpiece 10 is a crankshaft 20, the central main bearings 21 of which establish the center axis of the workpiece 10 and thus the rotation axis 22 thereof for the grinding. The rotation axis 22 is at the same time the rotation axis 22 of the work headstock 11 and the tailstock 16, which is indicated by the curved arrow C1. The work headstock 11 has a chuck 12 with chuck jaws 13 for rotationally driving the workpiece and a center 14 for centering the workpiece 10. A tailstock 16 having a center 17 is arranged at the other end of the crankshaft 20. It can be displaced in the Z direction, that is to say parallel to the rotation axis 22, for adaptation to the length, of the workpiece 10. The workpiece 10 can also be moved in this Z direction, it being possible for the movement to be carried out by a cross slide (not shown here) under the multiple-bearing grinding headstock 8, as indicated by the arrow Z1. Said cross slide can then be displaced in the Z1 direction, that is to say parallel to the center axis of the workpiece 10. These infeed movements are preferably carried out in a CNC-controlled manner.

Figure 3:
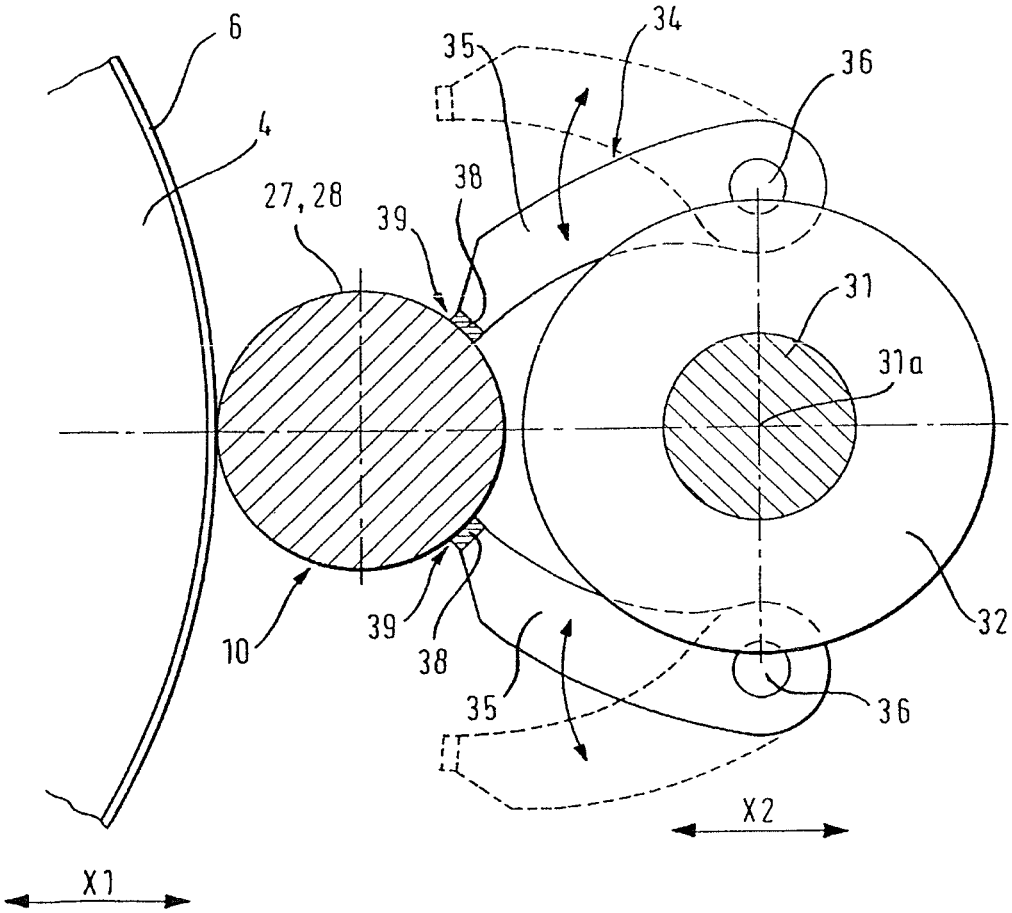
FIG. 3 shows a detailed view of a grinding-supporting unit according to the invention in engagement with the workpiece.
Figure 4:
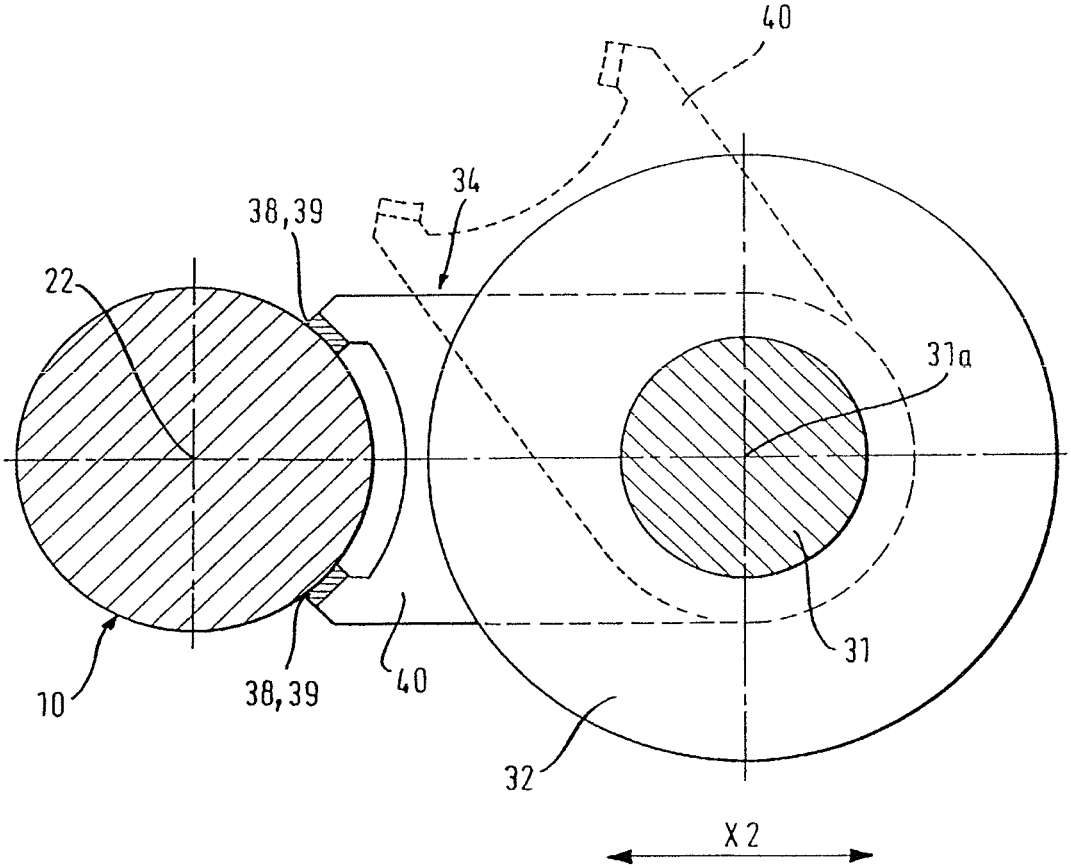
FIG. 4 shows a further embodiment of a grinding-supporting unit having a pivotable supporting body.

The grinding supporting unit 30 according to the invention is located in the front region of the grinding machine 1, i.e. on the other side of the workpiece 10 with respect to the multiple-bearing grinding headstock 8, and is shown in a very simplified form. In a grinding headstock 24, the grinding-supporting unit 30 carries a rotationally drivable grinding spindle 31 having a grinding wheel 32 and the supporting jaws 35 or supporting bodies 40, which are not shown here but are shown in FIGS. 3 and 4. The grinding wheel 32 is preferably designed as a ceramically bonded CBN (cubic boron nitride) grinding wheel. It serves primarily to grind a supporting element seat 28 on a bearing point 27, intended for this purpose, of the workpiece 10. The infeed thereof in the X2 axis is preferably likewise CNC-controlled. The grinding-supporting unit 30 is mounted for this purpose on the grinding table (in the version with the Z axis), which is not shown here, or on the machine bed (in the version with the Z1 axis), which is likewise not shown.

The grinding-supporting unit 30 is arranged with respect to the workpiece 10 and the multiple-bearing grinding headstock 8 with the grinding wheel set 5 in such a way that the grinding wheel 32 thereof, when in use, comes into engagement at the same bearing point 27 of the workpiece as one of the grinding wheels 4 of the grinding wheel set 5. This is preferably one of the central grinding wheels 4, since a deflection of the workpiece 10 to be compensated is greatest in the central region. During simultaneous engagement of both the grinding wheel 32 and the grinding wheel set. 5 on the workpiece 10, the opposite grinding wheels 4 and 32 in each case act as a support for the workpiece 10 in the manner of a steady rest, as explained in more detail with reference to FIG. 2. The other bearing points 27 are in this case likewise ground by the other grinding wheels 4 of the grinding wheel set 5, but are not supported. However, this is not crucial, since it is sufficient in practice for only one bearing point 27, and a substantially centrally situated one, to be supported against bending of the workpiece 10 as a result of grinding forces. It is, however, possible within the scope of the invention to fit the grinding-supporting unit with a plurality of grinding wheels 32 and associated supporting elements 34 and thus grind a plurality of supporting element seats. In this way, a plurality of bearing points 27 to be ground can be supported, as already explained with reference to one bearing point 27. The individual steps of the method according to the invention do not change as a result. It is also possible for a plurality of grinding-supporting units to be used in the case of long workpieces.

Figure 6:
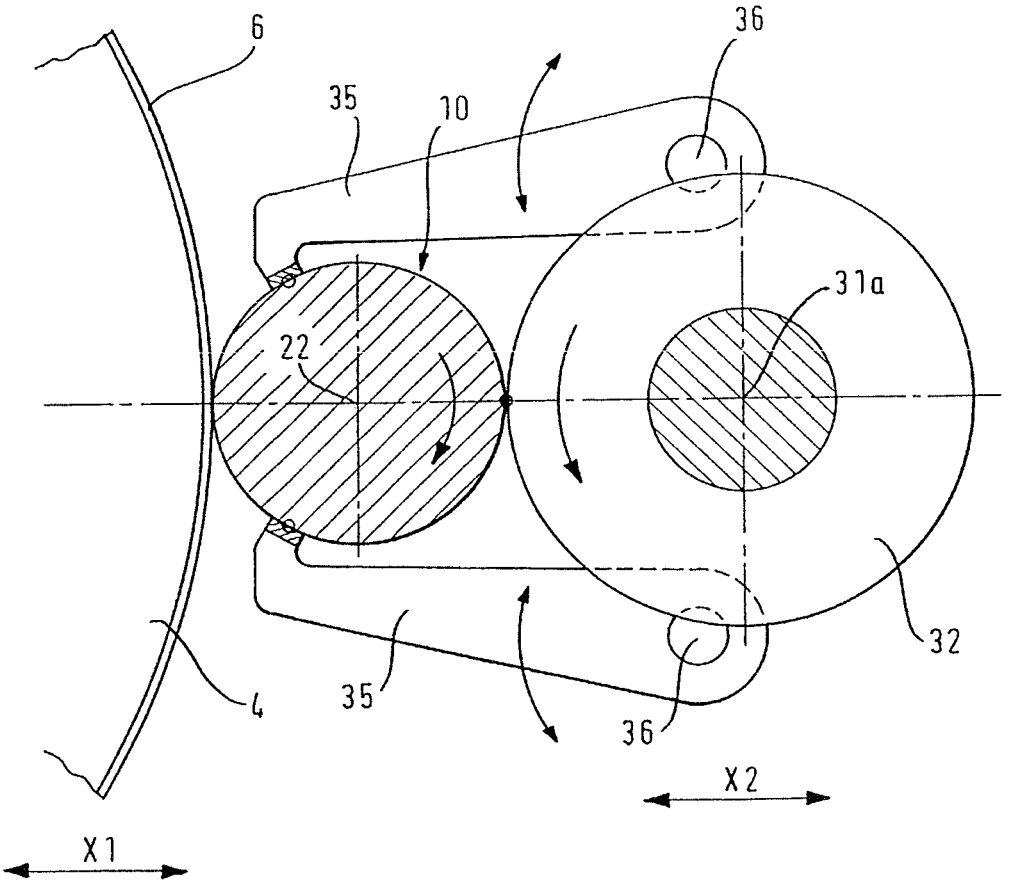
FIG. 6 shows a further design of the grinding-supporting unit according to the invention in use.

According to the invention, not only does the grinding wheel 32 of the grinding-supporting unit 30 serve as a support for the workpiece 10 during certain phases of the grinding, but further supporting elements 34 are also used, such as swing-in supporting jaws 35 or supporting bodies 41, which are shown in FIGS. 3, 4 and 6.

With the device described, a plurality of pin bearings can of course be jointly ground in an advantageous manner, for which purpose the crankshaft 20 must be clamped eccentrically in such a way that the rotation axis 22 comes to lie in the center axis of the pin bearings 23. During the conventional grinding of in each case a pair of pin bearings 23, the grinding-supporting unit 30 is used at one of the two pin bearings 23, while the other pin bearing 23 is ground at the same time, but without support. Of course, support at a plurality of bearing points 27 is also possible here, as already explained with reference to the production of crankshafts.

Figure 2:
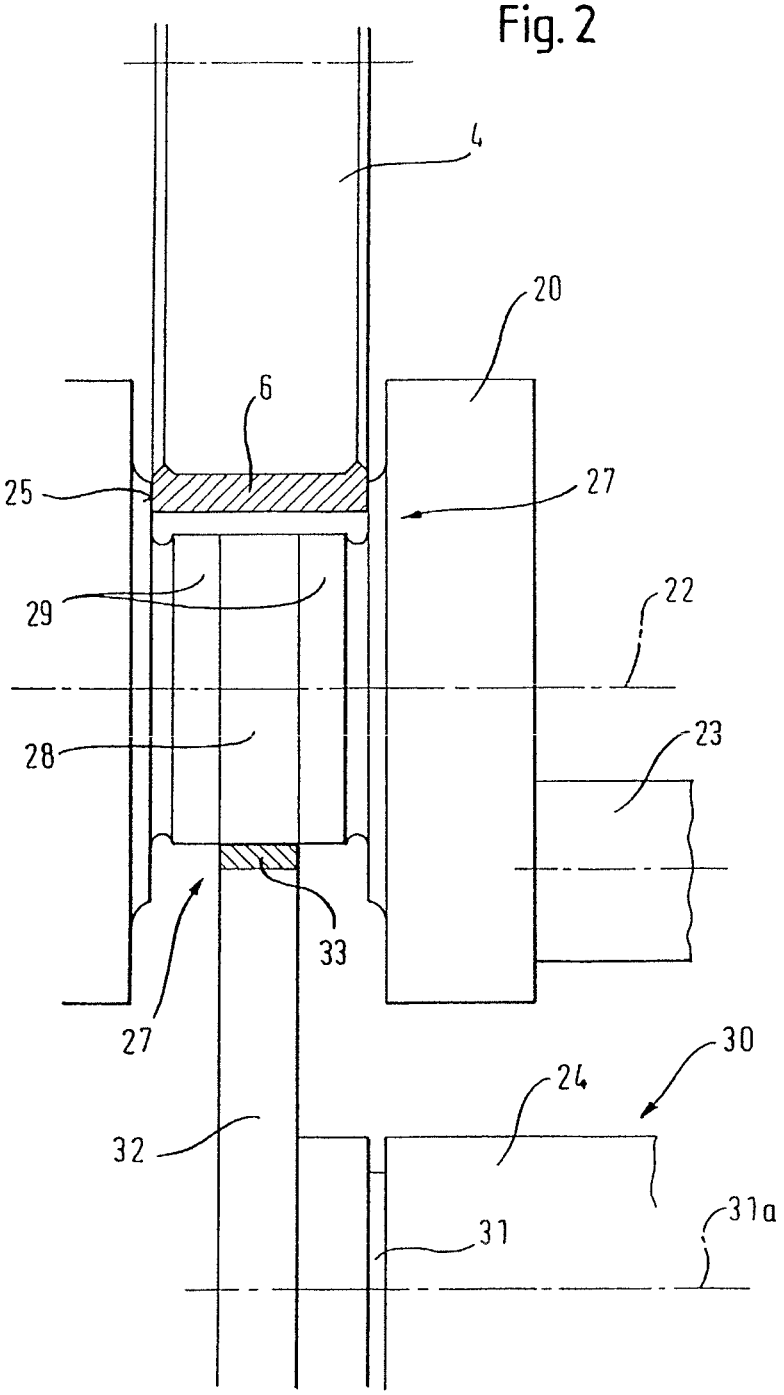
FIG. 2 shows a detailed view of the grinding of a supporting element.

The first grinding of the supporting element seat 28 using the grinding wheel 32 of the grinding-supporting unit 30 is shown in a detailed view in FIG. 2. Here, the bearing point 27 is a central main bearing 21 of a crankshaft 20, which is set in rotation about the rotation axis 22 during the grinding. The grinding wheel 4 is fed in in the X1 direction from one side of the bearing point 27 and grinds by means of the grinding layer 6 the flat sides 25 or flat shoulders 26 of the bearing points of the crankshaft 20. At the same time, the grinding wheel 32 is fed in from the opposite side of the crankshaft 20 to the hitherto still unmachined bearing point 27 and grinds a supporting element seat 28 there, for which purpose it is set in rotation via the grinding spindle 31. In the example shown, this supporting element seat 28 advantageously usually has a smaller width than a finish-ground main bearing 21, so that regions 23 that are not yet machined can be seen on both sides of the supporting element seat 28. The presence of such regions 29 is, however, not absolutely necessary. In principle, the supporting element seat 28 can occupy the full width of the main bearing point.

In this procedure, in which grinding wheels 4 and 32 are simultaneously fed in from opposite sides to the same bearing point 27 of the workpiece 10, each of the grinding wheels 4, 32 acts as a supporting means for the workpiece 10 against bending transversely to its longitudinal axis—the rotation axis 22. An effect, as produced by a steady rest is therefore obtained. This effect is also transmitted to the other bearing points 27, which are simultaneously ground by the other grinding wheels 4 of the grinding wheel set 5.

It goes without saying that, at a more advanced stage of the machining than that shown in FIG. 2, the grinding wheel 4 also grinds the actual bearing point 27, that is to say a main bearing 21 of the crankshaft 20, if it has, as shown, in FIG. 2, a grinding layer 6 suitable for this purpose and is fed in accordingly. According to one embodiment of the method, according to the invention, the grinding wheel 32 of the grinding-supporting unit 30 can be set in a freely rotating manner at least for the last phases of the finish grinding and therefore acts only as a means for supporting the workpiece, in the course of which it is supported by the supporting jaws 35 or supporting bodies 40 (see FIGS. 3 and 4), which are not shown here. According to another embodiment of the method according to the invention, the grinding wheel 32 of the grinding-supporting unit 30 can also be withdrawn by a short distance with respect to the workpiece 10 for the finish grinding, whereupon only the supporting jaws 35 or supporting bodies 40 brought to bear against the supporting element seat 28, ground beforehand, of the workpiece 10 are in contact with the latter.

FIG. 3 shows the already-mentioned supporting elements 34 of the grinding-supporting unit 30 in the form of supporting jaws 35 in the swung-in state. To this end, the grinding wheel 32 is withdrawn by a small amount of lift after the grinding of the supporting element seat 28, such that the workpiece 10 is supported solely by the supporting jaws 35, whereas the grinding wheel 4 for grinding the bearing points 27, such as, for instance, a main bearing 21 of a crankshaft 20, is in engagement with the workpiece 10 on the opposite side of the bearing point 27.

The design of the supporting elements 34 and the swinging-in thereof or otherwise bringing them into engagement with the workpiece 10 must of course be such that the supporting parts 39 of the respective supporting element 34, 35, 40 on the one hand make contact with the supporting element seat 28 produced beforehand with the grinding wheel 32 and on the other hand do not collide with the grinding wheel 32 or parts of the workpiece 10. The supporting jaws 35 according to FIG. 3, which are mounted with the pivot axis 36 at the side of the grinding wheel 32, are therefore of cranked design in the front region with the supporting point 39.

The supporting jaws 35 can preferably be swung in hydraulically onto a fixed stop (not shown here). However, other drive variants, such as, for instance, a linear infeed, can also be realized. The supporting jaws 35 are swung out (shown by broken lines) during the grinding of the supporting element seat 28. When the supporting element seat 28 is finish-ground, the supporting jaws 35 are swung in and the bearing points 27 on the workpiece 10 can also be ground to finished size.

In order to be able to realize a high degree of stiffness and short pivoting distances of the supporting jaws 35 for the support, said, supporting jaws 35 are preferably arranged on the grinding wheel guard 43 (cf. FIG. 7), to which the cooling lubricant nozzles for the grinding process are usually also fastened. By means of the axis X1, the grinding wheel or wheels 4 is or are fed in for grinding the bearing seats. The axis X2 is fed in to a certain infeed value, such that the workpiece 10 is supported for grinding the bearing points 27. The position of the supporting jaws 35 can be exactly controlled by the infeed amount, such that the workpiece 10 is either only supported or even subjected to slight "excess pressure" in order to be able to make dimensional corrections during the grinding. The supporting jaws 35 can also perform a follow-up movement, according to the position of the X1 axis, such that they constitute a type of following steady rest during the grinding of the bearing points 27.

It is also possible to grind the supporting element seat virtually to finished size, such that the grinding-supporting unit 30 has to be fed in to a predetermined value of the X2 axis and does not have to perform a follow-up movement according to the X1 axis.

In the front region, the supporting jaws 35 have a friction- and wear-reducing layer 38, which preferably consists of PCD (polycrystalline diamond) or CBN (carbon boron nitride).

Shown in FIG. 4 is a further embodiment of the supporting elements 34 in which two supporting points 39 are united in a common supporting body 40. The supporting points 39 are still provided with the wear- and friction-reducing layer 38. The outer contour of the layer 38, said outer contour coming to bear against the supporting element seat 28 on the workpiece 10, is designed in such a way that no edge load occurs.

Figure 4A:
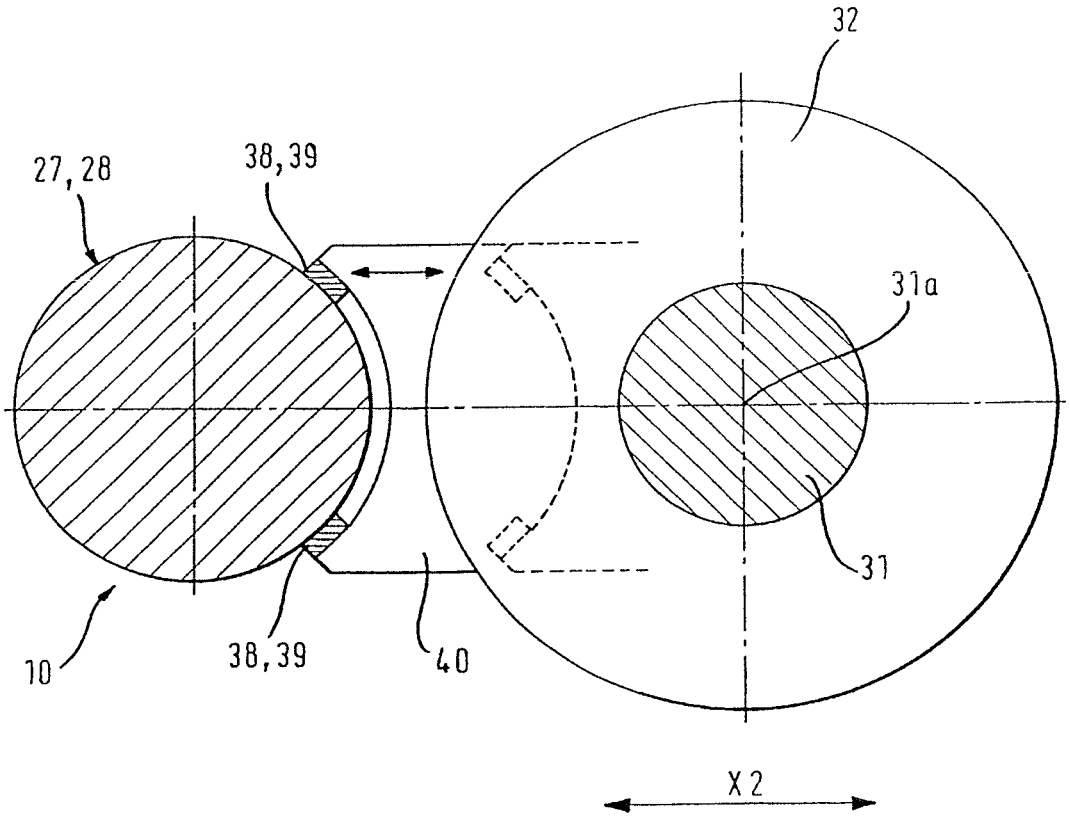
FIG. 4A shows a grinding-supporting unit according to FIG. 4 but with a linear displacement of the supporting body.
Figure 5A:
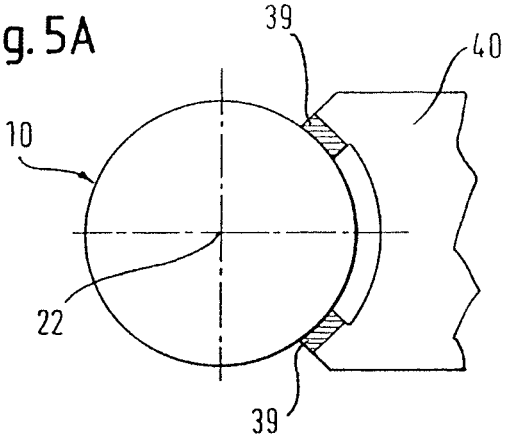
FIGS. 5A and 5B show further design variants of the grinding-supporting unit.

Between the two spaced-apart supporting points 39, the supporting body 40, due to its design, is further away from the workpiece 10 than the supporting points 39, which here are formed symmetrically on the supporting body 40, as can also be seen in FIG. 5A. In the exemplary embodiment shown, the supporting body 40 can be pivoted about an axis which coincides here with the rotation axis 31*a* of the grinding spindle 31. Other designs for the supporting body 40, the arrangement of the supporting points 39 and the type of infeed to the workpiece 10 are of course also conceivable. Thus the supporting body 40 can also be designed to be pivotable about axes different from the rotation axis 31*a* of the grinding spindle 31 or can be moved linearly on a slide, as shown in FIG. 4A. In all cases, it is expedient to coordinate and control the infeed or removal of the supporting jaws 35 or of the supporting bodies 40 with the various method steps during the grinding by means of a CNC control, whether hydraulically or electromechanically.

To swing in the supporting bodies 40 according to FIG. 4, it may be necessary to remove the grinding-supporting unit 30 by a certain amount in the X2 direction and to then set it again against the workpiece 10 with swung-in supporting body 40. It goes without saying that, when the supporting body 40 is mounted laterally next to the grinding wheel 32, as indicated in FIG. 4, the front end of the supporting body 40 is cranked with the supporting points 39 so that the supporting points 39 can be brought to bear on the supporting element seat 28 ground beforehand by the grinding wheel 32. Alternatively, it is of course possible to compensate for a lateral offset between the grinding wheel 32 and the supporting points 39 of supporting elements 34, 35, 40 by a movement of the grinding-supporting unit 30 in the Z direction, which for this purpose can be arranged, for example, on a cross slide having associated controllable drives.

An arrangement with a supporting body 40 is shown in FIG. 5A, wherein the supporting points 39 with the layer 38 are set at the same angle relative to the grinding wheel 32 and the center axis or rotation axis 22 of the workpiece 10.

Figure 5B:
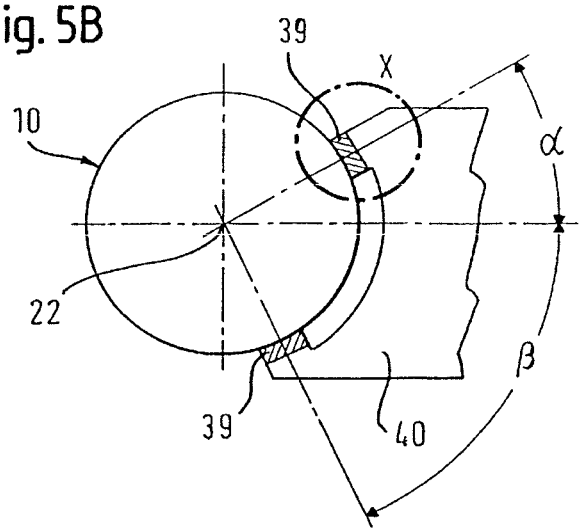

FIG. 5B shows an embodiment which is advantageous depending on the workpiece 10, wherein the angles $\alpha$ and $\beta$ of the supporting points 39 with respect to the connecting line between the rotation axis 31*a* of the grinding spindle 31 and the rotation axis 22 of the workpiece 10 are different. This embodiment can prove to be advantageous on account of the forces resulting from the grinding process.

Figure 5C:
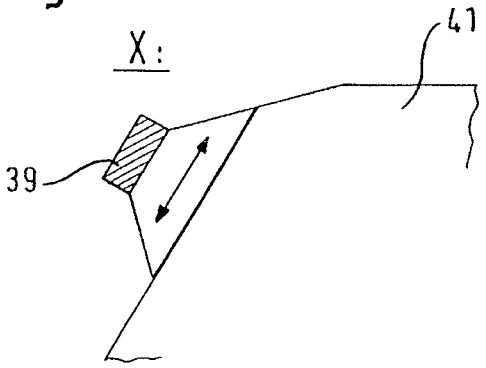
FIG. 5C shows a detailed view of an adjustable supporting element in a design according to FIG. 5B.

A further embodiment of a supporting body 41 is shown in FIG. 5C as a detail of FIG. 5B, wherein the supporting points 39 are adjustably arranged on a parent body 41 and can be clamped in a fixed position again after the setting. This setting can be shifted, according to the workpiece 10, for instance when using the grinding-supporting unit 30 at different workpieces 10. The setting then remains constant when grinding workpieces 10 of the same kind. This adjustment can be carried out at one or at both supporting points 39 (top/bottom) on the parent body 41.

FIG. 6 shows a further advantageous embodiment. Here, the grinding wheel 32 of the grinding-supporting unit 30 is not withdrawn after the grinding of the supporting element seat 28, but rather remains at the finished-size position of the supporting element seat 28 and the supporting jaws 35 of the supporting-element unit 30 are closed. The workpiece 10 is now supported at 3 points. The drive of the grinding wheel 32 is stopped, before the supporting jaws 35 are swung in and the grinding wheel 32 can rotate freely with the workpiece 10. This results in a type of control wheel (cf. centerless grinding) which supports the workpiece 10. After the supporting jaws 35 are closed, the workpiece 10 is clamped centrally in its center position and a type of following steady rest results. The X2 axis is again made to follow the X1 axis in a CNC-controlled manner, such that the center axis of the workpiece 10 is kept exactly centrically when the nominal size is reduced during the grinding of the bearing. The supporting jaws 35 are likewise made to follow changes in the diameter of the bearing point 27. This procedure can represent a self-centering/following steady rest.

Figure 7:
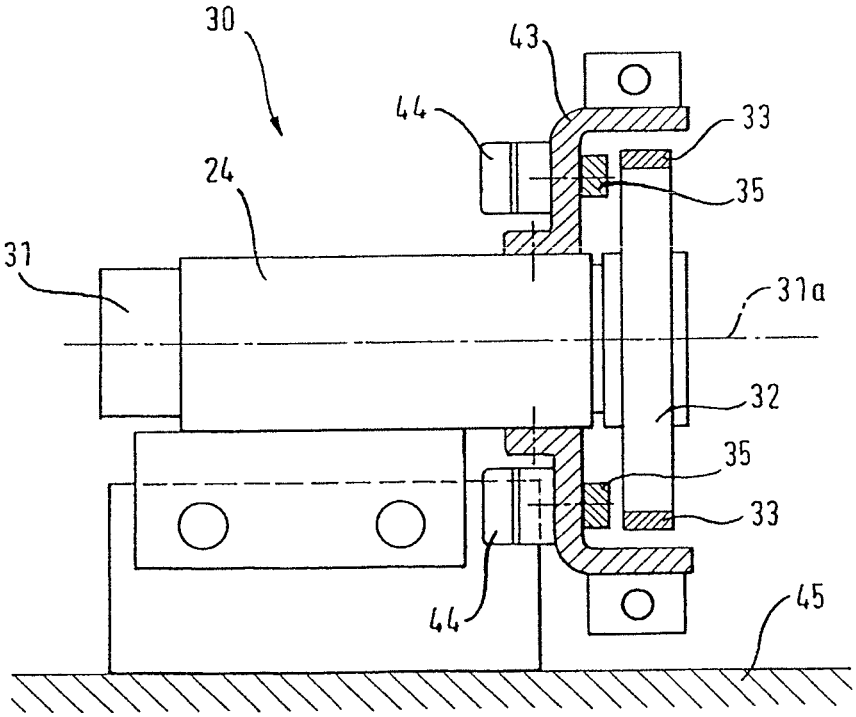
FIG. 7 shows a partial view of the grinding-supporting unit according to the invention from the side.

A partial view of FIG. 1 is shown in FIG. 7 and illustrates an embodiment of the grinding-supporting unit 30. The grinding-supporting unit 30 is fastened on the machine bed 45 or the grinding table and has a preferably CNC-controlled infeed axis in the X2 direction. Here, this infeed axis is realized by an infeed slide 47 which is traversable on the housing 46. The housing 46 serves to accommodate the guide columns and the drive of the X2 axis and is mounted on the grinding table 45. Mounted on the infeed slide 47 is a grinding spindle 31, which can be fed in at right angles to the workpiece longitudinal axis, which corresponds to the rotation axis 31*a*. A grinding wheel 32 is accommodated on the rotor of the grinding spindle 31. The grinding wheel guard 48 is mounted on the parent body of the grinding spindle or on the grinding headstock housing, said grinding wheel guard 48 accommodating the cooling tubes 43 for the cooling lubricant feed on the outer region and the drives and bearing arrangement 44 for the swinging-in of the supporting jaws 35 in the outer region next to the grinding wheel 32.

The invention claimed is:

1. An apparatus for the multiple-bearing grinding of workpieces, the apparatus comprising:

a grinding wheel set having multiple grinding wheels configured to grind a plurality of bearing points simultaneously, the grinding wheel set being arranged on a common grinding spindle in a multiple-bearing grinding headstock arranged for infeeding of the grinding wheel set in at least a radial X1 direction with respect to the workpiece, a work headstock for supporting the workpiece and rotating the workpiece about a rotation axis, and a grinding-supporting unit spaced from the multiple-bearing grinding headstock and configured to be fed into the workpiece and removed therefrom in a linear, radial X2 direction, the grinding-supporting unit having at least one further grinding headstock and a grinding wheel for grinding a supporting element seat disposed proximate to the grinding-supporting unit, the grinding wheel configured to at least partly support at least one bearing point during the grinding of the workpiece by the grinding wheel set thereby compensating for deformations of the workpiece caused by grinding forces, the grinding wheel of the further grinding headstock coupled to the at least one further grinding headstock via a grinding spindle, and at least one moveable supporting element coupled to the at least one further grinding headstock for grinding the supporting element seat and arranged for infeeding to bear against the supporting element seat, wherein, the multiple grinding wheels are disposed in contact with a first side of the workpiece and the grinding wheel of the grinding-supporting unit is disposed in contact with a second side of the workpiece, the second side being opposite the first side, during grinding of side faces or the at least one bearing point and wherein, the moveable supporting element which is coupled to the at least one further grinding headstock lies on the second side of the workpiece and is arranged for infeeding to bear against the supporting element seat, with the multiple grinding wheels in grinding engagement on the first side of the workpiece, the first side being opposite the second side.

2. The apparatus as claimed in claim 1, wherein the infeed of the multiple-bearing grinding headstock in the X1 direction and the infeed of the grinding-supporting unit with the further headstock in the X2 direction are controllable independently of one another.

3. The apparatus as claimed in claim 1, further comprising a grinding wheel guard coupled to the at least one further grinding headstock, wherein the at least one supporting element of the grinding-supporting unit is arranged on the grinding wheel guard and is configured to move with the further grinding headstock.

4. The apparatus as claimed in claim 3, wherein the at least one supporting element is pivotable about a rotation axis of a grinding spindle of the further grinding headstock.

5. The apparatus as claimed in claim 3, wherein the at least one supporting element is a swing-in supporting jaw.

6. The apparatus as claimed in claim 1, wherein the at least one moveable supporting element of the grinding-supporting unit comprises at least one supporting jaw or a supporting body which is pivotable about a pivot axis or which is linearly movable.

7. The apparatus as claimed in claim 6, wherein the grinding supporting unit comprises a supporting body which is arranged on the further grinding headstock and which is movable independently of the further grinding headstock.

8. The apparatus as claimed in claim 6, wherein the supporting body comprises two supporting points provided with a friction and wear reducing layer.

9. The apparatus as claimed in claim 8, wherein the supporting points are arranged symmetrically on the supporting body with respect to the connecting line between the rotation axis of the grinding spindle and the rotation axis of the workpiece.

10. The apparatus as claimed in claim 8, wherein the supporting points are arranged such that angles $\alpha$ and $\beta$ of the supporting points with respect to the connecting line between the rotation axis of the grinding spindle and the rotation axis of the workpiece are different.

11. The apparatus as claimed in claim 8, wherein the supporting points are arranged adjustably on a parent body of the supporting body.

12. The apparatus as claimed in claim 1, wherein the at least one supporting element has, at a surface in contact with the workpiece, a friction- and wear-reducing layer.

13. The apparatus as claimed in claim 12, wherein the layer is of polycrystalline diamond or cubic boron nitride.

14. The apparatus as claimed in claim 1, wherein the supporting element seat comprises a steady rest seat.

* * * * *